US006475131B1

(12) United States Patent
Yoshida et al.

(10) Patent No.: US 6,475,131 B1
(45) Date of Patent: Nov. 5, 2002

(54) METHOD OF CLEANING ROTARY DRUM OF HORIZONTAL DRUM-TYPE CENTRIFUGAL SEPARATOR USING A SOLID CLEANING MEDIUM

(75) Inventors: Takao Yoshida; Saihei Yano, both of Tokyo (JP)

(73) Assignee: Tomoe Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/743,780

(22) PCT Filed: May 25, 2000

(86) PCT No.: PCT/JP00/03357

§ 371 (c)(1),
(2), (4) Date: Jan. 11, 2001

(87) PCT Pub. No.: WO00/74859

PCT Pub. Date: Dec. 14, 2000

(30) Foreign Application Priority Data

Jun. 9, 1999 (JP) ..... 11-162226

(51) Int. Cl.[7] ..... B04B 15/06

(52) U.S. Cl. ..... 494/27; 494/37; 134/7; 134/8

(58) Field of Search ..... 494/23, 27–30, 494/37, 43, 56, 85; 210/210, 211, 217, 772, 781, 784, 791, 796, 797; 134/7, 8

(56) References Cited

U.S. PATENT DOCUMENTS 3,102,055 A * 8/1963 Faigen et al.
4,036,426 A * 7/1977 Little
4,060,587 A * 11/1977 Lewis ..... 134/8
4,158,576 A * 6/1979 Butz ..... 134/7
4,978,331 A * 12/1990 Luchetta et al. ..... 494/37

FOREIGN PATENT DOCUMENTS

| | | |
|---|---|---|
| GB | 2121325 | * 12/1983 |
| JP | 39-005797 | * 4/1964 |
| JP | 50-076640 | * 6/1975 |
| JP | 52-017572 | * 2/1977 |
| JP | 53-022300 | * 7/1978 |
| JP | 56-121601 | * 9/1981 |
| JP | 6-024701 | * 4/1994 |
| JP | 6-182322 | * 7/1994 |
| JP | 10-180147 | * 7/1998 |
| JP | 11-023151 | * 1/1999 |

* cited by examiner

*Primary Examiner*—Charles E. Cooley
(74) *Attorney, Agent, or Firm*—Drinker Biddle & Reath LLP

(57) ABSTRACT

This invention provides a cleaning method for removing sediment from the inner wall of the rotary drum of a horizontal drum-type centrifugal separator which comprises charging a plurality of solid cleaning medium pieces such as globules, balls, cubes, rods, springs etc., into the rotary drum, supplying a cleaning liquid to the rotary drum, rotating the drum, and discharging the sediment together with the cleaning liquid. The solid cleaning medium is charged into the rotary drum either before centrifugal separation or at the time of cleaning after centrifugal separation.

6 Claims, 2 Drawing Sheets

METHOD OF CLEANING ROTARY DRUM OF HORIZONTAL DRUM-TYPE CENTRIFUGAL SEPARATOR USING A SOLID CLEANING MEDIUM

FIELD OF THE INVENTION

This invention relates to a method of effectively removing solids that have sedimented and remain in a rotary drum, of an industrial horizontal drum-type centrifugal separator which separates a slurry of either a singular solution or a mixture of composite solutions containing low concentrations of settleable substances into solids and liquid or into solids and liquids of different specific gravities (e.g., oil and water). This invention relates especially to the removal of a layer of solids that has stuck fast to the inner wall of the drum.

BACKGROUND OF THE INVENTION

Drum-type centrifugal separators have extensively been used because their use of centrifugal force permits separation of mixtures that can be difficult to separate using other centrifugal separators, such as decanter type separators or disk-type centrifugal separators, and also because of the lower price of drum-type centrifugal separators as compared to the other types. When sediment has built up on the inner wall of the rotary drum of a centrifugal separator as a result of the separating operation is to be removed, it is standard practice to disassemble the machine and scrape off the sediment by hand or using manual scraping tools. This maintenance is essential for this type of centrifugal separator since the sediment not removed from the rotary drum will increasingly affect the clarity of the separated liquid.

Thus the use of larger centrifugal separators for greater treatment capacity has not been done because the attendant disassembly time required for the sediment removal from the rotary drum, and the corresponding decrease in operation time is even greater with a larger capacity machine. Given current practices, drum-type centrifugal separators are limited to use in situations where only small volumes of mixtures or mixtures with low solids content are treated for purification. In applications where larger quantities of mixtures or mixtures with high solids content are handled, either centrifugal separators of other types are used or a centrifugal separator of other type is combined with a drum-type centrifugal separator to perform two-step treatment.

The removal of solid matter that has deposited on the inner wall of a rotary drum, after disassembly, requires considerable time and labor, especially when the time span between stopping the machine and the disassembly is substantial, when a thick sediment has built up, or when the separated solids, by nature, harden readily.

As stated above, it has been standard practice with conventional drum-type centrifugal separators that, removal of sediment that has settled on the inner wall of the rotary drum has involved inefficient methods that consist, for example, of disassembling the machine and scraping off the sediment by hand or using manual scraping tools. Employment of larger machines to achieve greater treatment capacity has been hindered by the difficulties involved in the removal of sediment from the rotary drum as described above. Drum-type centrifugal separators have, therefore, been limited in use to the applications where only small volumes of mixtures or mixtures with low solids content are treated for purification. In applications where larger quantities of mixtures or mixtures with high solids content, other methods have to be employed, including combined use of the centrifugal separator with one of other separator types.

Thus it is the object of the present invention to obviate the above-described necessity of disassembling and the concomitant labor involved in the removal of sediment from the rotary drum and to automate the separation process.

It is another object of the present invention to permit the use of larger drum-type centrifugal separators than heretofore used without attendant increases in downtime for disassembly.

Still another object of the present invention is to preclude the necessity of disassembly and to automate the removal of sediment from drum-type centrifugal separators of the sizes currently in common use.

SUMMARY OF THE INVENTION

The present invention solves the foregoing problems by a cleaning method for removing sediment from the inner wall of the rotary drum of a horizontal drum-type centrifugal separator having first and second ends terminating in trunnions supported by bearings, the method comprising: charging a plurality of solid cleaning medium pieces into the rotary drum, supplying a cleaning liquid to the rotary drum, rotating the rotary drum, and to remove sediment from the inner wall thereof, discharging the sediment together with the cleaning liquid.

The solid cleaning medium may be charged into the rotary drum either before centrifugal separation or after the centrifugal separation, at the time the drum is cleaned, and may be added either together with the cleaning liquid or before the introduction of the cleaning liquid.

These two alternative procedures are defined as follows. The first procedure (hereinafter called Procedure 1) is a cleaning procedure for removing sediment from the inner wall of the rotary drum of a horizontal drum-type centrifugal separator having first and second ends terminating in trunnions supported by bearings, the method comprising charging a plurality of solid cleaning medium pieces into the rotary drum, allowing the solid cleaning medium pieces to deposit on the inner surface of the rotary drum, feeding a liquid to be treated, subjecting the liquid to centrifugal separation in batch operation to form a sediment, supplying a cleaning liquid to the rotary drum, rotating the rotary drum at a speed to attain not more than 1 G, to remove sediment from the inner wall thereof, and discharging the sediment together with the cleaning liquid.

The second procedure (hereinafter called Procedure 2) is a cleaning procedure for removing sediment from the inner wall of the rotary drum of a horizontal drum-type centrifugal separator having first and second ends terminating in trunnions supported by bearings, the method comprising: supplying a plurality of solid cleaning medium pieces and a cleaning liquid to the rotary drum while the drum is decelerating or after it has stopped, rotating the rotary drum at a speed to attain not more than 1 G to remove sediment from the inner wall thereof and discharging the sediment together with the solid cleaning medium pieces and the cleaning liquid.

In conformity with the invention, there is provided a horizontal drum-type centrifugal separator that does not require the conventional manual scraping off of sediment can be realized.

DETAILED DESCRIPTION OF THE INVENTION

Figure 1:
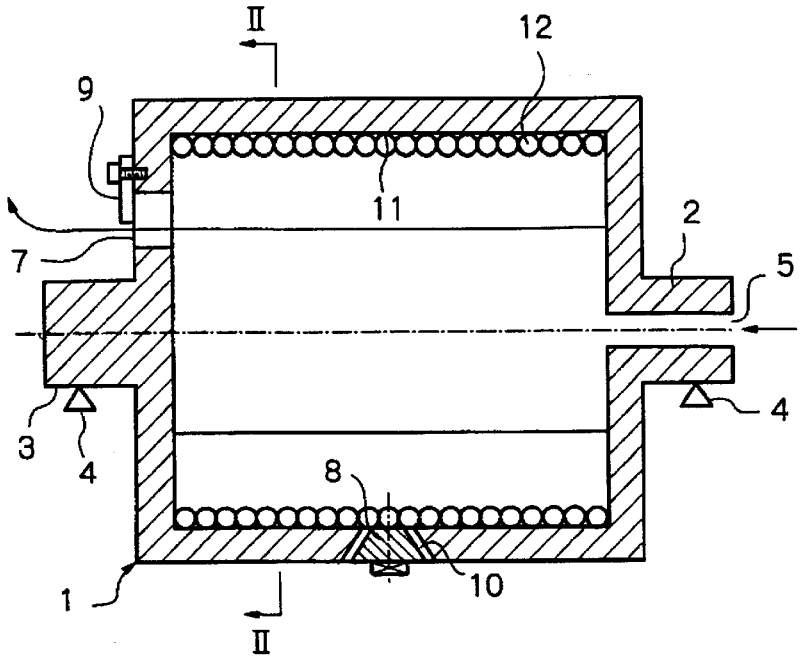
FIG. 1 is a cross sectional view of a typical rotary drum of a horizontal drum-type centrifugal separator for practicing the method of the invention.

The cleaning method according to the invention provides for cleaning the rotary drum of a horizontal drum-type centrifugal separator that is supported for rotation at both ends by bearings and is used in separating a slurry of either a singular solution or a mixture of composite solutions containing low concentrations of settleable substances into a solid sediment and sediment-free liquid.

The invention is suitably applicable to the removal of the sediment that has built up on the inner wall of the rotary drum of a horizontal drum-type centrifugal separator designed for separating solids from liquids that contain low concentrations of suspended solids. Substrates for treatment using a centrifugal separator include water and aqueous solutions, non-aqueous solutions of organic matter and organic solutions, and composite solutions such as water-oil mixtures, e.g., engine oils and blood. Although the tendency to form deposits on the interior surface of the drum depends on the size of the separator used and on the duration of separating operation, it may generally be said that the lower the concentration of solids in a liquid to be separated the better will be the result. For example, a slurry with a solids content in excess of 1% by weight tends to form a solid deposit rapidly on the interior surface of the rotary drum. This solid deposit will. eventually decrease the clarity of the resulting treated liquid. Also, a large amount of solid deposit makes the method of the present invention uneconomical from the viewpoint of operation efficiency.

The cleaning method according to the invention consists of removing a sediment batchwise from the inner wall of a rotary drum. It is characterized by the use, as means for separating or scraping off the sediment from the inner wall of the rotary drum, of a plurality of pieces of solid cleaning medium which are rotated or moved by a water stream within the drum or by rotation of the drum.

The present invention may be practiced by either or both of the following two procedures.

1. A cleaning procedure in which the solid cleaning medium is placed in the rotary drum before feeding into the drum a liquid to be treated.

2. A cleaning procedure in which the solid cleaning medium is introduced into the rotary drum after completion of a separation, during the course of cleaning the drum.

These two procedures will be more fully explained below.

1. A cleaning procedure in which the solid cleaning medium is placed in the rotary drum before feeding into the drum a liquid to be treated.

The rotary drum is first charged with solid cleaning medium pieces, comprising from tens to hundreds of pieces. The solid cleaning medium pieces may comprise globules, balls, cubes, rods, or springs, and may range from several millimeters to several centimeters in size. The solid cleaning medium pieces may be composed of rubber, metal, ceramic, plastic or the like having a greater specific gravity than the liquid to be separated. The solid cleaning medium pieces are employed in an amount calculated to be sufficient for settling closely, leaving no space between the pieces, on the inner wall of the drum.

The solid cleaning medium may be introduced into the rotary drum either separately or as mixed with a cleaning liquid in a cleaning liquid tank provided separate from a raw liquid tank. The mixture may be supplied by a pump or head directly into the rotating drum prior to the separating treatment. As the rotary drum is rotated, the solid cleaning medium thus supplied is uniformly distributed on the inner wall of the drum by centrifugal force. The uniformly distributed solid cleaning medium may comprise a single layer; or it may form a plurality of layers , when multiple layers are necessary.

After the solid cleaning medium layer has been formed, a slurry to be separated is continuously fed to the rotary drum. Solid matter is centrifugally sedemented and deposited on the inner surface of the solid cleaning layer. To complete the separating operation, the raw liquid feeding is stopped and the drives of the rotary drum are switched off. As the rotary drum slows down to a speed (X rpm) at which the gravity is slightly greater than the centrifugal force acting on the solid cleaning medium, the medium inside the drum begins falling from the upper part of the rotating drum. The sediment on the inner surface of the solid cleaning medium layer comes off also. The falling solid cleaning medium is thrown against the lower part of the rotary drum, whereby the cleaning efficiency is enhanced. In this way the sediment that sticks fast to the inner wall of the rotary drum is easily removed, compared with the ordinary procedure of removal by disassembly that involves much difficulty. Combined use of the cleaning liquid and the solid cleaning medium at speeds below X rpm causes the cleaning medium to generate a high turbulence in the liquid, thus further promoting the cleaning efficiency. To remove the sediment from the rotary drum, the cleaning liquid is supplied to the rotary drum while the drum is rotating at X rpm, and the sediment and the solid cleaning medium are forced out through a discharge port. The discharge port is opened by employing an electronically or manually operated valve, or by manually removing a plug that seals the port. As a further alternative, a separated liquid outlet may be utilized for the discharge purpose.

2. A cleaning procedure in which the solid cleaning medium is introduced into the rotary drum after completion of a separation, during the course of cleaning the drum.

After the conclusion of a centrifugal separation, the feeding of raw liquid and the rotation of the rotary drum 1 are stopped. Next, solid cleaning medium pieces, comprising tens to hundreds of solid cleaning medium pieces are charged into the rotary drum. The solid cleaning medium pieces may be in the form of globules, balls, cubes, or rods, and may range from several millimeters to several centimeters in size. The solid cleaning medium pieces are not limited as to the specific gravity (especially the elastic balls known as magic balls) of the pieces, and are supplied to the rotary drum through the raw liquid feed line or via an exclusive feed port. The rotary drum is then driven at a speed not high enough for the elastic balls to stick completely to the inner wall of the rotary drum under the influence of centrifugal force. An ideal speed is the speed X rpm which produces a centrifugal force of approximately 1 G at which the elastic balls are moved centrifugally to an apex inside the rotary drum and then fall from the apex when the force of gravity exceeds the centrifugal force. Thus the impact of the rolling elastic balls on the solid layer of sediment, and the direct impingement of the elastic balls falling by gravity from an apex inside the rotary drum down onto the solid sediment layer at a lower part of the drum, combine to crush and finely divide the hardened solid sediment layer. At this point in the cleaning process, it is desirable to reverse the direction of the rotation of the centrifugal separator, because, this increases the impacting and crushing action of the solid cleaning medium pieces for the cleaning purpose.

Hard balls composed of steel or ceramic may be used in place of the elastic balls. The shape of the solid cleaning medium pieces may also be varied, said shapes comprising for example, polyhedrons, in addition to globules and balls.

Following the cleaning, the elastic balls are discharged together with the washings from the centrifugal separator.

Procedures 1 and 2 may be used either singly or in combination. The solid cleaning medium is not limited to a single size, shape, or material and may be a combination of different sizes, shapes or materials.

According to Procedure 1, a solid cleaning medium is supplied to a rotary drum prior to a separation procedure so as to form a layer of solid cleaning medium pieces on the interior surface of the rotating drum. Then, a separating treatment is performed. Since sediment is kept out of direct contact with the inner wall of the rotary drum by the layer of solid cleaning medium pieces, it can be easily removed from the drum.

According to Procedure 2, a separation procedure is performed and the resulting sediment on the inner wall of a rotary drum is subsequently subjected to impingement by a solid cleaning medium, whereby it can be easily removed from the drum.

EXAMPLES

An embodiment of the present invention is described below with reference to the accompanying drawings of FIG. 1, FIG. 2 and FIG. 3.

Figure 2:
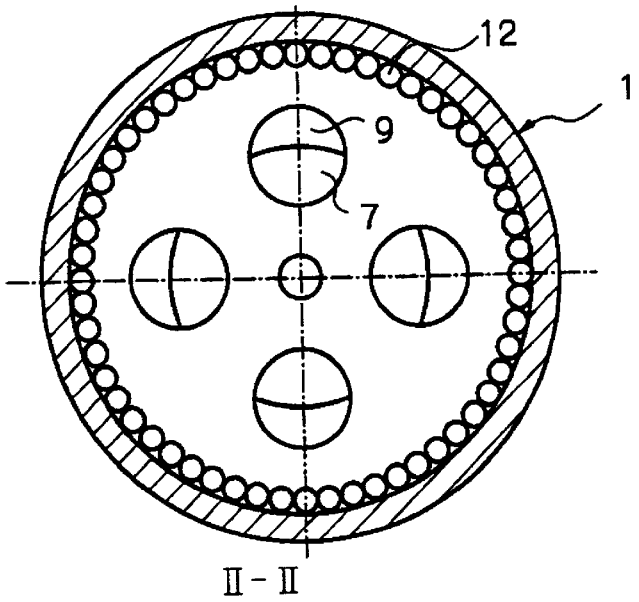
FIG. 2 is a transverse sectional view taken on the line II—II of FIG. 1.

A rotary drum of a horizontal drum-type centrifugal separator preferably embodying the invention is illustrated in FIGS. 1 and 2.

The numeral 1 indicates a rotary drum of a horizontal drum-type centrifugal separator having left and right end walls, with trunnions 2 and 3 supported by bearings 4, which is driven at high speed revolution by a motor (not shown). The right hand trunnion 2 in FIG. 1 has a feed port 5 through which a liquid to be treated is supplied to the rotary drum during a separation operation. In addition either a cleaning liquid or the solid cleaning medium or both may be supplied to the rotary drum through port 5 during a cleaning operation. The left end wall of the rotary drum comprises port 7 for discharging a separated liquid and orifice diaphragm 9 for adjusting the diameter of the discharge port. In addition, the rotary drum 1 is provided with a recovery opening 8 through which solid cleaning medium pieces 12 are removed from the rotary drum and also with a plug 10 which closes the recovery opening 8.

In one embodiment of the invention, the inner walls 11 of the rotary drum 1 are provided with a smooth finish. In a preferred embodiment of Process 1, balls are used as the solid cleaning medium 12 and the inner wall 11 of rotary drum 1 is finished with an even spacing of dents in a size large enough to receive and temporarily hold a part of the ball-shaped solid medium on the inner wall 11 of the rotary drum, and in a number and distribution sufficient to cover the inner wall with an even layer of solid cleaning medium pieces when all of the dents in the surface of inner wall 11 are occupied by solid cleaning medium pieces. The greater capability of the dented inner surface 11 to temporarily hold a ball-shaped solid medium piece is advantageous for the practice of Process 1, since, in that process, it is desirable to distribute the solid cleaning medium 12 substantially evenly and fully on the inner wall 11 of the rotary drum before the introduction of a liquid to be treated. This even distribution of solid cleaning media effectively prevents separated sediment from a subsequent separation operation from collecting directly on the inner wall surface. The aforementioned dents may be formed by grid-forming or any other suitable technique. In one embodiment, when the solid cleaning medium to be used is globular in shape, the dents are formed with the same radius of curvature as that of the solid cleaning medium.

Figure 3:
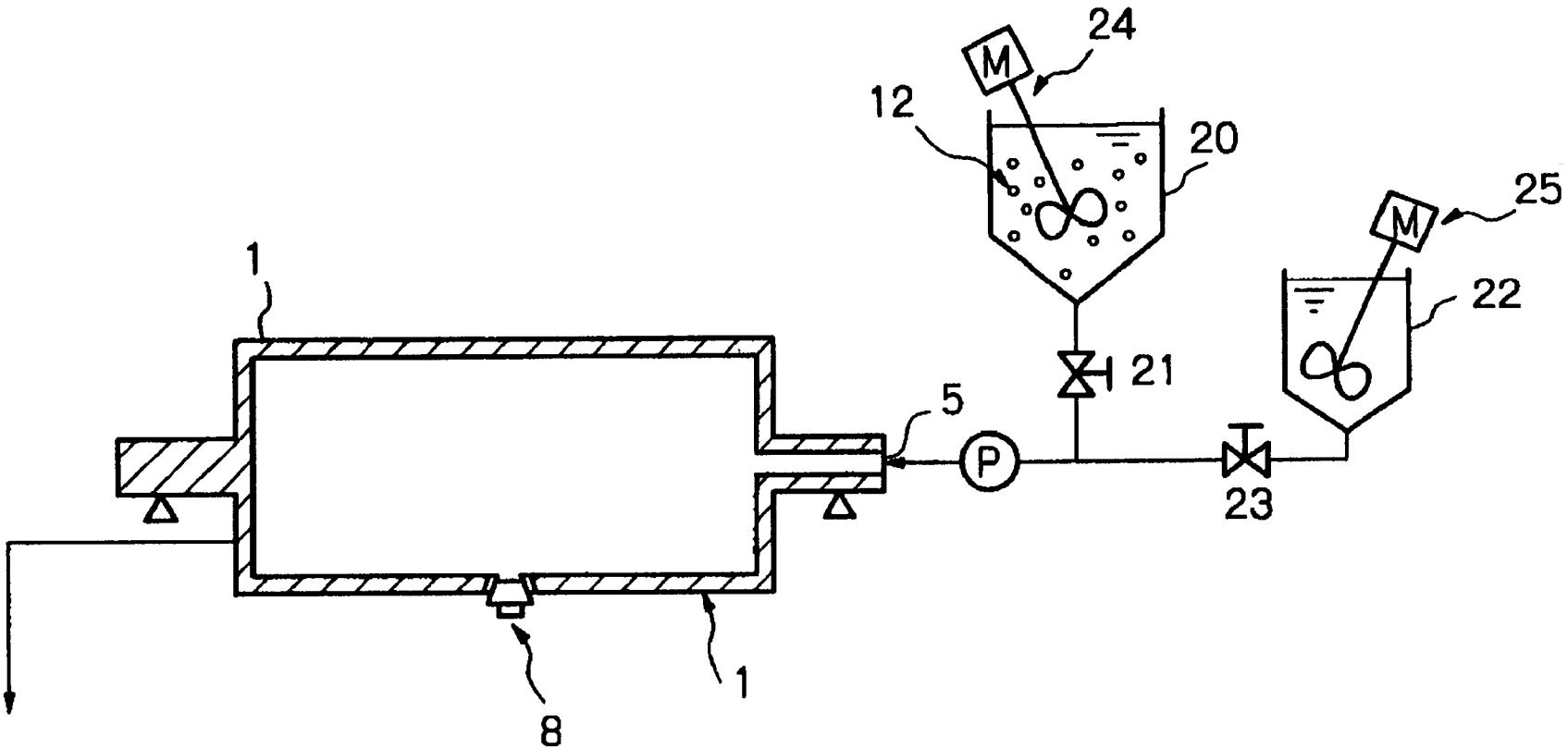
FIG. 3 is a schematic view of a centrifugal separation system for practicing the method of the invention.

FIG. 3 schematically illustrates an embodiment of the centrifugal separator cleaning system of the invention with which either of the two cleaning procedures according to the present invention may be carried out.

The numeral 1 indicates a rotary drum of a horizontal drum-type centrifugal separator which is the same as or similar to the one described above in conjunction with FIG. 1. When practicing Procedure 2 the inner wall of the rotary drum need not be machined with surface dents in the manner described above.

The rotary drum has a feed port 5 which is connected to a solid cleaning medium tank 20 through a feed pump P and a valve 21. The solid cleaning medium tank 20 is filled with a dispersion of solid cleaning medium 12 in the form of a multiplicity of globules or the like in water or another solvent used as a cleaning liquid. The cleaning liquid mixed with the solid cleaning medium is stirred, when necessary, by an agitator 24 which is driven by a motor M. A liquid to be treated (raw liquid) containing approximately 1% (or preferably less than 1%) solid matter is fed from a raw liquid tank 22. The raw liquid tank 22 can also be equipped with an agitator 25 driven by a motor M.

In practicing Procedure 1, a horizontal drum-type centrifugal separator having a rotary drum 1 as shown in FIGS. 1 and 2 is used. First, the rotary drum is charged with a solid cleaning medium 12 in an amount calculated to be sufficient to form a layer of solid cleaning medium completely covering the inner wall 11. The solid cleaning medium may be directly introduced into the rotary drum before centrifuging. In the embodiment shown, the solid cleaning medium and cleaning liquid are mixed in a solid cleaning medium tank 20, and the mixture is supplied by opening a valve 21 to the inside of the rotary drum 1 by a pump P. The solid cleaning medium 12 so supplied is evenly settled on the inner wall 11 of the rotary drum by the centrifugal force. After the layer of solid cleaning medium has been formed, valve 21 is closed and valve 23 is opened to feed into the drum a slurry to be treated from a raw liquid tank 22 continuously to the inside of the rotary drum 1. A sediment component of the slurry is centrifugally settled and deposited on the inner surface of the layer of solid cleaning medium 12, and a clear liquid component of the slurry is separated out and leaves discharge port 7 as a purified liquid. When the separated solid deposit has built up to a predetermined level, feeding of the raw liquid is discontinued and the drives for the rotary drum 1 are stopped.

With the power for rotating the rotary drum 1 switched off, the rotation of the rotary drum slows down. At the point at which the drum's speed has come down to X rpm wherein the force of gravity exceeds slightly the centrifugal force acting on the solid cleaning medium 12, the solid medium begins to fall from an upper part of rotary drum 1, together with the sediment that has deposited on the inner surface of the solid medium layer. The falling solid cleaning medium falls under the influence of gravity to, and impinges on a lower part of the rotary drum, thereby adding to the cleaning efficiency. Combined use of the cleaning liquid with the solid cleaning medium at speeds below X rpm allows the solids to impart a vigorous turbulence to the liquid, further enhancing the cleaning efficiency.

For removal of the sediment from the rotary drum, the liquid from the cleaning liquid tank 20 is supplied to the rotary drum while the drum is rotating at X rpm, so that the sediment and the solid cleaning medium 12 are forced out through a discharge port 7. The remainder of solid cleaning medium 12 that cannot be removed through the port may be discharged by manually detaching a plug 10 which closes discharge port 8.

Procedure 2 involves some modifications in the sequence of operation. Referring to FIG. 3, valve 21 in the line from the outlet of the solid cleaning medium tank 20 is closed and valve 23 in the line from the outlet of the raw liquid tank 22 is open. The raw liquid to be centrifugally separated is fed to the rotary drum 1 of the centrifugal separator by a pump P, and the centrifugal separation is performed.

After the centrifugal separation operation is complete, the rotation of rotary drum 1 is stopped. Valve 21 is opened and valve 23 is closed, and solid cleaning medium pieces (especially the elastic balls known as magic balls) are supplied through feed port 5 to the inside of rotary drum 1. Alternatively, the solid cleaning medium pieces may be introduced into the centrifugal separator while the rotary drum 1 is decelerating. The rotary drum is then rotated at a speed (X rpm) which produces a centrifugal force of approximately 1 G at which the elastic balls are moved centrifugally to an apex inside the rotary drum and then fall from the apex by gravity to a lower elevation point on the interior surface of rotary drum 1. In other words the rotation speed of the rotary drum is such that the centrifugal force generated on the elastic balls of the solid cleaning medium is slightly less than that which would be required to hold the elastic balls against the inner wall of the drum throughout its rotation.

Thus when Procedure 2 is employed, the impact of the rolling elastic balls on the solid sediment layer and the direct impingement of the elastic balls falling by gravity from an apex inside the rotary drum upon the solid sediment layer combine to crush and finely divide the hard solid sediment layer. In a subembodiment of Procedure 2, the rotation of the rotary drum of the centrifugal separator is reversed , thus further increasing the force and frequency of impact and crushing action of the solid medium in the cleaning operation.

After the cleaning operation is complete, the elastic balls are discharged from the centrifugal separator together with the cleaning liquid.

In other embodiments of the invention, the composition of the solid cleaning medium may be of harder materials such as, for example, steel or ceramic. In addition the shape of the solid cleaning medium pieces may be varied, including for example shapes such as polyhedrons.

Procedures 1 and 2 may be used either alone or in any combination. The solid cleaning medium is not limited to a single size, shape, or material but may be any combination of different sizes, shapes or compositions thereof.

The present invention makes it possible to remove the accumulated sediment from the inside of a rotary drum more efficiently than heretofore possible by the use of a solid cleaning medium that eliminates the necessity of disassembly of the apparatus for cleaning.

The cleaning procedures of the present invention may be scaled up in size for use in batch-operation type centrifugal separators. Existing centrifugal separators can be easily adapted to use the present invention. in addition existing centriflgal separators capable of automation may be automated to employ the process steps of the present invention.

It is also provided that the cleaning Procedures of the present invention are effectively applicable to other types of centrifugal separator, such as the decanter type and the basket type having a filter medium.

We claim:

1. A cleaning method for removing sediment from the inner wall of a rotary drum of a horizontal drum-type centrifugal separator having first and second ends terminating in trunnions supported by bearings, the method comprising: charging a plurality of solid cleaning medium pieces into the rotary drum, supplying a cleaning liquid to the rotary drum, rotating the rotary drum to remove sediment from the inner wall thereof, and discharging the sediment together with the cleaning liquid.

2. The method of claim 1, wherein the solid cleaning medium pieces are charged into the rotary drum before feeding a liquid to be treated.

3. The method of claim 1, wherein the solid cleaning medium pieces are selected from a group consisting of globules, balls, cubes, rods, coils, and polyhedrons of rubbers, metals, ceramics, and plastics.

4. The method of claim 3, wherein the solid cleaning medium pieces consist of a highly elastic material.

5. A cleaning method for removing sediment from the inner wall of a rotary drum of a horizontal drum-type centrifugal separator having first and second ends terminating in trunnions supported by bearings, the method comprising: charging a plurality of solid cleaning medium pieces into the rotary drum, allowing said solid cleaning medium pieces to deposit on the inner surface of the rotary drum, feeding a liquid to be treated, subjecting said liquid to centrifugal separation in batch operation to form a sediment, supplying a cleaning liquid to the rotary drum, rotating the rotary drum at a speed to attain not more than 1 G to remove sediment from the inner wall thereof, and discharging the sediment together with the cleaning liquid.

6. A cleaning method for removing sediment from the inner wall of a rotary drum of a horizontal drum-type centrifugal separator having first and second ends terminating in trunnions supported by bearings, the method comprising: supplying a plurality of solid cleaning medium pieces and a cleaning liquid to the rotary drum while the rotary drum is decelerating or after the rotary drum has stopped, rotating the rotary drum at a speed to attain not more than 1 G to remove sediment from the inner wall thereof, and discharging the sediment together with the solid cleaning medium pieces and the cleaning liquid.

* * * * *